United States Patent [19]

Gladding

[11] Patent Number: 4,700,761

[45] Date of Patent: Oct. 20, 1987

[54] SWAG BAG

[76] Inventor: Samuel Gladding, R.D. #4, Box 281, Montrose, Pa. 18801

[21] Appl. No.: 888,876

[22] Filed: Jul. 24, 1986

[51] Int. Cl.[4] ..... A45C 3/00; A45C 13/26

[52] U.S. Cl. ..... 150/111; 150/109; 150/113; 190/108; 224/205

[58] Field of Search ..... 150/109, 108, 111, 113; 190/108; 224/203, 205, 257, 258

[56] References Cited

U.S. PATENT DOCUMENTS

| | | | |
|---|---|---|---|
| 3,696,850 | 10/1972 | Rosenblum | 190/108 |
| 4,068,786 | 1/1978 | Taniguchi | 150/108 X |
| 4,094,351 | 6/1978 | Catenaccio | 383/38 X |
| 4,153,092 | 5/1979 | Haslam | 150/108 |
| 4,164,308 | 8/1979 | Gautier | 150/109 |
| 4,424,841 | 1/1984 | Smith | 190/108 X |

FOREIGN PATENT DOCUMENTS

| | | | |
|---|---|---|---|
| 855081 | 5/1940 | France | 150/111 |
| 907760 | 3/1946 | France | 150/109 |
| 333075 | 8/1930 | United Kingdom | 150/108 |

*Primary Examiner*—William Price
*Assistant Examiner*—Sue A. Weaver

[57] ABSTRACT

A bag combination having first and second independent bag units detachably connected to an adjustable shoulder strap, such that a first bag unit can be positioned under a person's arm and a second bag unit can be positioned diagonally downwardly across a person's back, with the adjustable strap therebetween extending diagonally upwardly across the person's front. Separate straps are provided for each bag unit when they are detached. Decorative and safety materials are incorporated in the bag units.

1 Claim, 2 Drawing Figures

FIG. 1
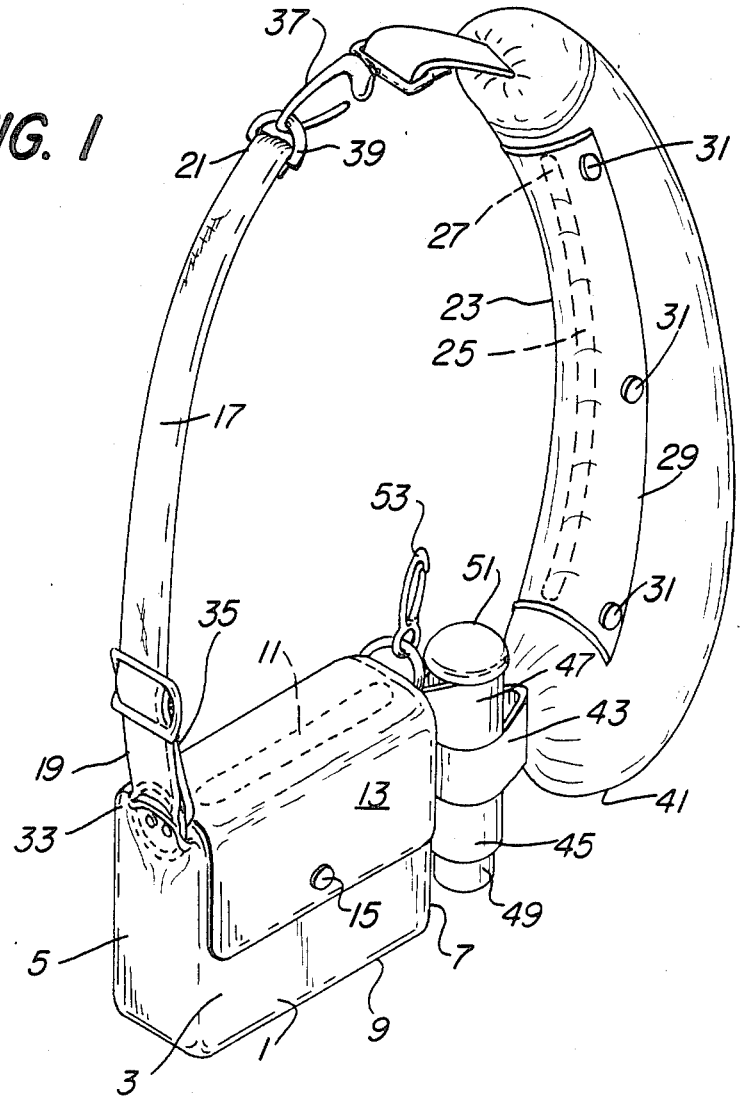
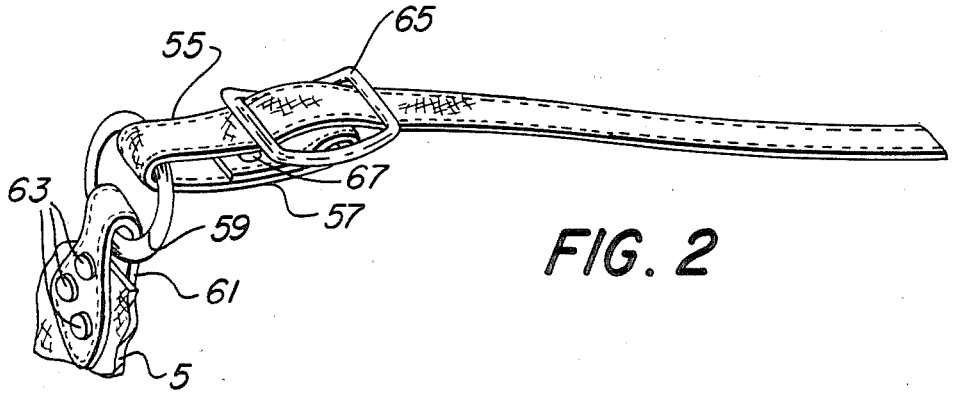
FIG. 2

SWAG BAG

BACKGROUND OF THE INVENTION

The present invention relates to bags and pertains particularly to a bag convertible to more than one mode of use.

Handbags that can be transformed into shoulder bags are known and popular because of this versatility. Such bags are particularly useful for hikers and bike riders who may frequently carry backpacks and also a second form of bag for personal items. For such type of person it is desirable that the two forms of bags can be converted into a single unit or divisible into multiple units depending on the need of the individual.

SUMMARY OF THE INVENTION

Accordingly it is the primary object of the present invention to provide a bag that is convertible into multiple types of bags. A still further object of the present invention is to provide a bag which can be convertible into two distinct and separate bags depending on the need of the individual and which can also be reconverted back into a single combination bag having more than one bag unit connected to each other.

BRIEF DESCRIPTION OF THE DRAWINGS

The above and other objects and advantages of the present invention will become apparent from the following description when read in conjunction with the drawings, wherein:

FIG. 1 is a front perspective view of a bag according to the present invention showing the first bag unit and the adjustable strap interconnected to the second bag unit.

FIG. 2 is a perspective view of the adjustable carrying strap for use in combination with the first and second bag units of the invention.

DESCRIPTION OF PREFERRED EMBODIMENT

Turning now to the drawings and particularly to FIG. 1, there is illustrated a bag having a first bag unit 1, with a front sidewall 3, a back sidewall opposite thereof, a forward sidewall 5, a rear sidewall 7, connected to a bottom 9, all defining a compartment having a top opening 11 in phantom. Means for opening and closing said top opening 11, is shown generally as a hinged flap 13, having a button fastener 15, although other fastening means, which are conventional, could be used including a zipper combination or a device sold under the tradename, Velcro.

A shoulder strap 17 having a first and second end, 19 and 21 respectively, has first end 19 connected to said first bag unit at said forward sidewall 5. Said shoulder strap unit 17 is of sufficient adjustable length to position said first bag unit at a person's side beneath the arm and extend diagonally upward across said person's front to position second end 21 adjacent a shoulder opposite said arm. An elongated second bag unit 23 extends between second end 21 and rearward sidewall 7 of first bag unit 1. The second bag unit is generally of a flexible material such as cloth, and has a top opening 25 (shown in phantom) which is formed by sidewalls and a bottom portion which are integral. The closure 27 for said top opening 25 can be standard such as a hinged flap 29 with buttons 31, zipper or a tradename Veloro closure device.

The shoulder strap 17 is connected at first end 19 to said first bag unit 1 at said forward sidewall portion by conventional means such as a ring 33 and loop 35 arrangement. Second end 21 is removably connected to second bag unit 23 by a swivel clip 37 and loop 39, although a buckle arrangement is equivalent.

Second bag unit 23 is removably connected at its lower end 41 to first bag unit 1 at rearward sidewall 7 by means of a plurality of interlaced loops 43, 45, 47 held together with a large pin 49 with a flattened head 51. The pin and loop combination provides a decorative aspect in addition to the utilization aspect, although other fastening means, such as buckles or swivel clip would work. A second fastening means 53 is provided on first bag unit 1 for such use as hereinafter disclosed.

When it is desirable to separate the first and second bag units, the adjustable shoulder strap 17 can be detached from said second bag unit and connected to second fastening means 53 to provide a shoulder strap for said first bag unit alone. A seoond independent shoulder strap which is normally carried inside one of the bag units, can thereafter be connected to said second bag unit at swivel clip 37 and at a similar swivel clip (not shown) attached to second bag unit 23 at lower end 41 to provide a means for carrying second bag unit alone.

I prefer to make the second bag unit 23 of a flexible material, such as cloth having a highly decorative pattern printed or woven in order to provide aesthetic appearance. Alternatively, reflective material could be incorporated in both bag units in order to provide safety features for purposes of hiking or biking at night.

When in use in combination form, the first and second bag units are connected by means of adjustable shoulder strap 17. Said strap extends upwardly across the person's front and over an opposite shoulder and second bag unit extends downwardly across said persons back to provide a secure mounting upon the person and permit the person to have freedom of use of both hands.

As shown in FIG. 2, one means for making shoulder strap 17 adjustable is disclosed. One end 55 of adjustable strap 17 is doubled back to form loop 57. A ring 59 passes through loop 61 and is secured to end panel 5 by conventional means such as rivets 63. End 55 is redoubled to engage adjusting buckle 65 and secured with rivet 67. The use of buckle 65 to provide a carrying strap of adjustable length is well known in the art. Other adjusting means of conventional design will work.

It would be equivalent to reverse the position of swivel clip 37, loop 39 with that of ring 33 and loop 35 and to provide a separate strap for bag unit 1, while strap 17 is used for bag unit 2, which then becomes part of an integral strap 17. Bag unit 2 extends between sidewall 7 and a midpoint at strap 17, thereby occupying a position of midback on the person.

I claim:

1. A swag-bag comprising:

(a) a first bag unit having a top opening and means for opening and closing said top opening;

(b) an adjustable length shoulder strap, having a first and second end, said first end fastened to said first bag unit at a forward sidewall portion, said shoulder strap of sufficient length to position said first bag unit at a person's side beneath an arm and to extend diagonally upwardly across said person's front to position said second end adjacent a shoulder opposite said arm; and (c) an elongated second bag unit extending between said second end of said shoulder strap and a rearward sidewall portion of said first bag unit; means for removably connecting one end of said second bag unit to said second end of said shoulder strap and another end of said second bag to said first bag unit at a rearward sidewall portion; and means for opening and closing said second bag unit.

* * * * *